US008579724B2

(12) United States Patent
Evans

(10) Patent No.: US 8,579,724 B2
(45) Date of Patent: Nov. 12, 2013

(54) GOLF CLUB HEAD WITH ADJUSTABLE WEIGHTING

(75) Inventor: D. Clayton Evans, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 318 days.

(21) Appl. No.: 13/220,408

(22) Filed: Aug. 29, 2011

(65) Prior Publication Data

US 2012/0064991 A1 Mar. 15, 2012

Related U.S. Application Data

(60) Provisional application No. 61/382,430, filed on Sep. 13, 2010.

(51) Int. Cl.
*A63B 53/06* (2006.01)

(52) U.S. Cl.
USPC ..... 473/334; 473/349

(58) Field of Classification Search
USPC ..... 473/334, 349
See application file for complete search history.

(56) References Cited

U.S. PATENT DOCUMENTS 5,916,042 A * 6/1999 Reimers ..... 473/334
2009/0088272 A1 * 4/2009 Foster et al. ..... 473/350

* cited by examiner

*Primary Examiner* — Benjamin Layno
(74) *Attorney, Agent, or Firm* — Rebecca Hanovice; Michael A. Catania; Sonia Lari

(57) ABSTRACT

A titanium bodied driver that utilizes a lightweight receiving back cap, which is designed to be non-removable from the club head but can be loosened to allow its interior to be accessed to reposition one or more movable weights into alternative receiving locations, is disclosed herein. The back cap may also be designed to be completely removable from the driver body to gain access to the one or more weights that can be re-positioned in alternative receiving areas within the back cap's interior.

17 Claims, 9 Drawing Sheets

GOLF CLUB HEAD WITH ADJUSTABLE WEIGHTING

CROSS REFERENCES TO RELATED APPLICATIONS

The present application claims priority to U.S. Provisional Patent Application No. 61/382,430, filed on Sep. 13, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a movable back weight configuration. More specifically, the present invention relates to a titanium driver with a lightweight receiving back cap designed to be loosened to allow access to an interior, repositionable weight.

2. Description of the Related Art

Technical innovation in the configuration, material, construction and performance of golf clubs has resulted in a variety of new products. The advent of metals as a structural material has largely replaced natural wood for wood-type golf club heads, and is but one example of this technical innovation resulting in a major change in the golf industry.

Titanium drivers have been used by golfers for over a decade. They represent the vast majority of the drivers produced and used around the world. Callaway Golf Company's second and third generation titanium driver body styles (Hawkeye '99 and Hawkeye '01) each used a secondary metal for weighting, tungsten and bismuth respectively. The tungsten was externally visible, while the bismuth was not. Callaway has not used dissimilar metal for weighting purposes on its titanium bodied drivers for several years, but has welded titanium pieces or used thicker, as-cast, weighting regions or varying wall thicknesses to accomplish weight placement. While this type of weighting is useful for performance, it does not provide strong talking points or visual cues to describe or illustrate performance intentions.

Although the prior art discloses many variations of golf club heads, the prior art fails to provide a club head with a high-performance weighting configuration with visual cues to describe or illustrate performance intentions.

BRIEF SUMMARY OF THE INVENTION

The inventors have found that, by incorporating certain design features into a driver design, a golfer may have an improved driver that is better suited to his or her needs, abilities, and preferences to hit better shots and have a unique method of interfacing with a movable weight of the driver head.

One such design feature is a moveable weight used to affect the position of the club head's center of gravity to provide ball trajectories that are better suited to the golfer's swing. Another design feature is the omission of welding operations from the driver and, as a result, eliminating the cost associated with purchasing secondary parts (faceplates, crown plates, sole plates, etc.) and the secondary operations (fixturing, grinding, blending, etc.) used to finish the club head. A further design feature is a affixing a moveable weight to a golf club head by housing it into a removable or captive, yet movable, back cap. Yet another design feature is the use of a lightweight material for the back cap, such as magnesium, composite graphite, aluminum, or plastic to minimize the mass of the back cap to provide more available mass for the movable weight.

One aspect of the present invention is a club head comprising a body comprising a face component and an aft body, wherein the body is integrally cast from a metal material, and wherein the aft body has an opening, a gasket covering the opening, a back cap having an interior surface, wherein the back cap is slidably affixed to the gasket, and at least one removable weight positioned on the interior surface of the back cap. In a further embodiment, the body may have a volume of approximately 440 to 480 cubic centimeters and a weight of 180 to 210 grams. In another embodiment, the interior surface of the back cap may have a plurality of predefined weight receiving locations, such as on a heel side and a toe side of the back cap. In another embodiment, the golf club head further comprises a screw, wherein the at least one removable weight is semi-permanently fastened to the interior surface of the back cap with the screw. In yet another embodiment of the present invention, the golf club head further comprises a plurality of screws, wherein the gasket is permanently affixed to the aft body with an adhesive, and wherein the back cap is semi-permanently affixed to the gasket with the plurality of screws.

In another further embodiment, the gasket and the back cap are each composed of a lightweight material, which may be selected from the group consisting of composite and aluminum, and the at least one removable weight is composed of a heavy material, which may be selected from the group consisting of stainless steel, titanium alloy, and tungsten alloy, having a density greater than the density of the lightweight material. In yet another further embodiment, the body is integrally cast from titanium alloy. In another embodiment, the aft body comprises a crown portion and a sole portion, and the opening is located in the sole portion.

The golf club head of the present invention may further comprise a slider tee comprising an end portion and a head portion, wherein the gasket comprises an elongated slot, wherein the back cap comprises a socket, wherein the end portion of the slider tee is threaded through the slot and fixed in the socket, and wherein the head portion of the slider tee is sized to prevent the slider tee from disengaging from the slot. The slider tee may be composed of a lightweight material selected from the group consisting of composite, aluminum alloy, magnesium, and plastic, and may permit the back cap to slide along a length of the elongated slot. The back cap may slide on a linear, rotational, or curved path along the length of the elongated slot.

Another aspect of the present invention is a driver-type golf club head comprising a body having a rearwardly located opening, wherein the body is composed of a titanium material, and wherein the body has a volume of approximately 440 to 480 cubic centimeters and a weight of 180 to 210 grams, a movable assembly covering the opening, and at least one weight member removably secured within the movable assembly, wherein the at least one weight member is composed of a high density metal material, and wherein the golf club head has no welding in its construction. In a further embodiment of the present invention, the movable assembly comprises a gasket and a back cap, and may further comprise a slider tee, wherein the gasket is composed of an aluminum material, wherein the gasket is affixed to the body with adhesive, wherein the slider tee movably connects the back cap to the gasket, and wherein the back cap is composed of a composite material. The at least one weight member may be composed of a metal material selected from the group consisting of stainless steel, titanium alloy, and tungsten alloy, and the body of the driver-type golf club head may be integrally cast.

Yet another aspect of the present invention is a driver-type golf club head comprising a body comprising a crown portion composed of a composite material, a face portion composed of a titanium alloy, and a sole portion composed of a titanium alloy, wherein the sole portion comprises a rearwardly located opening, and wherein the face portion and the sole portion are integrally cast, a gasket covering the opening, wherein the gasket is permanently affixed to the body with an adhesive material, and wherein the gasket is composed of an aluminum alloy, a slider tee, a back cap having an interior surface, wherein the back cap is slidably affixed to the gasket with the slider tee, at least one screw, and at least one removable weight secured to the interior surface of the back cap with the screw, wherein the golf club head has no welding in its construction, and wherein the body has a volume of approximately 440 to 480 cubic centimeters and a weight of 180 to 210 grams.

DETAILED DESCRIPTION OF THE INVENTION

The present invention is generally directed to a golf club head with a novel, movable weight configuration that allows a golfer to affect the position of the center of gravity in the club head to provide ball trajectories that are better suited to the golfer's swing. The movable weight may be housed in a removable back cap or a captive but movable back cap. The present invention is also directed to a golf club head created without welding operations, which reduces or eliminates the cost associated with purchasing secondary parts (faceplates, crown plates, sole plates, etc.) and the secondary operations (fixturing, grinding, blending, etc.) used to finish the club head.

Figure 1:
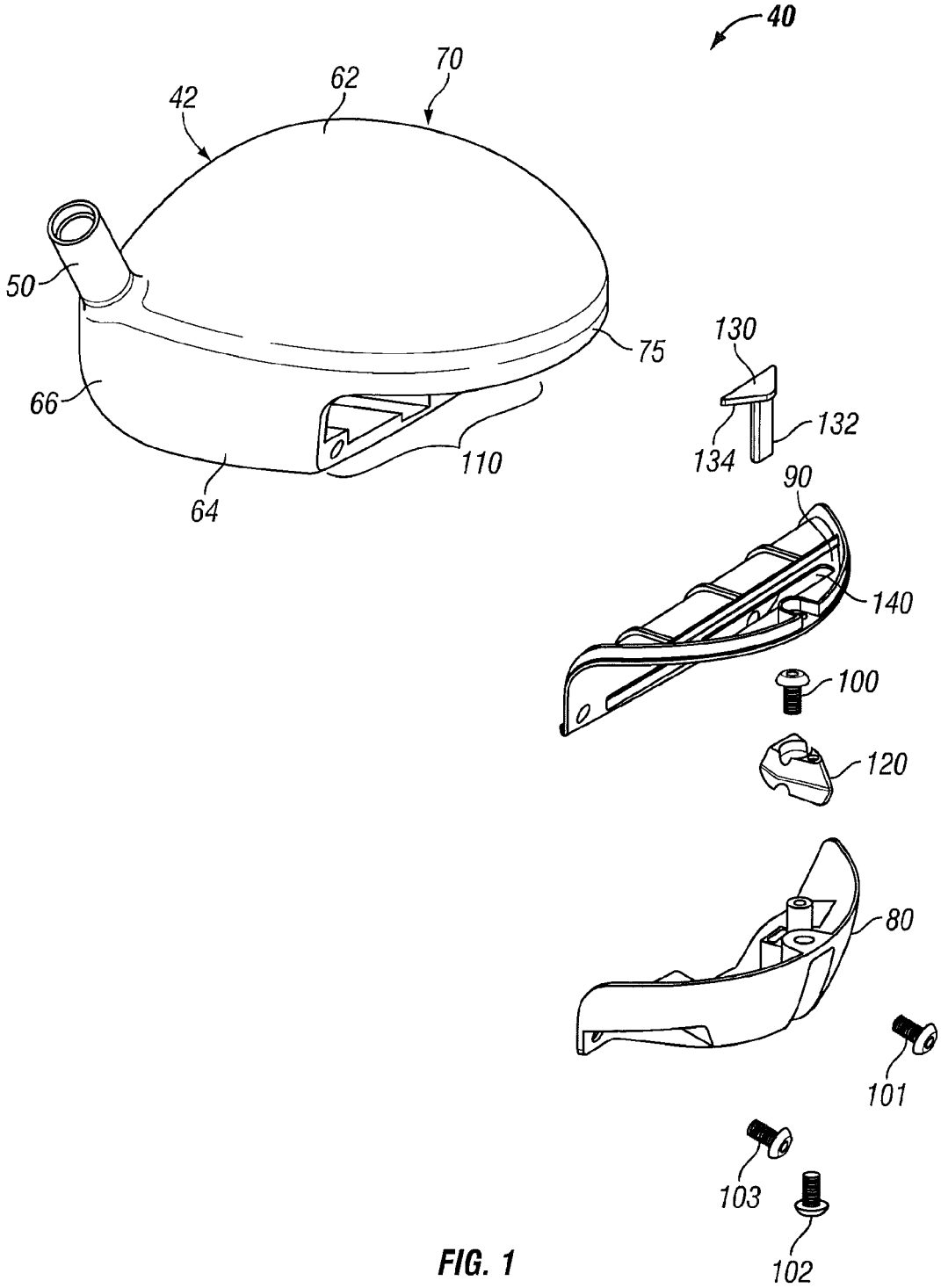
FIG. 1 is an exploded, rear, heel-side view of a golf club head according to an embodiment of the present invention.
Figure 2:
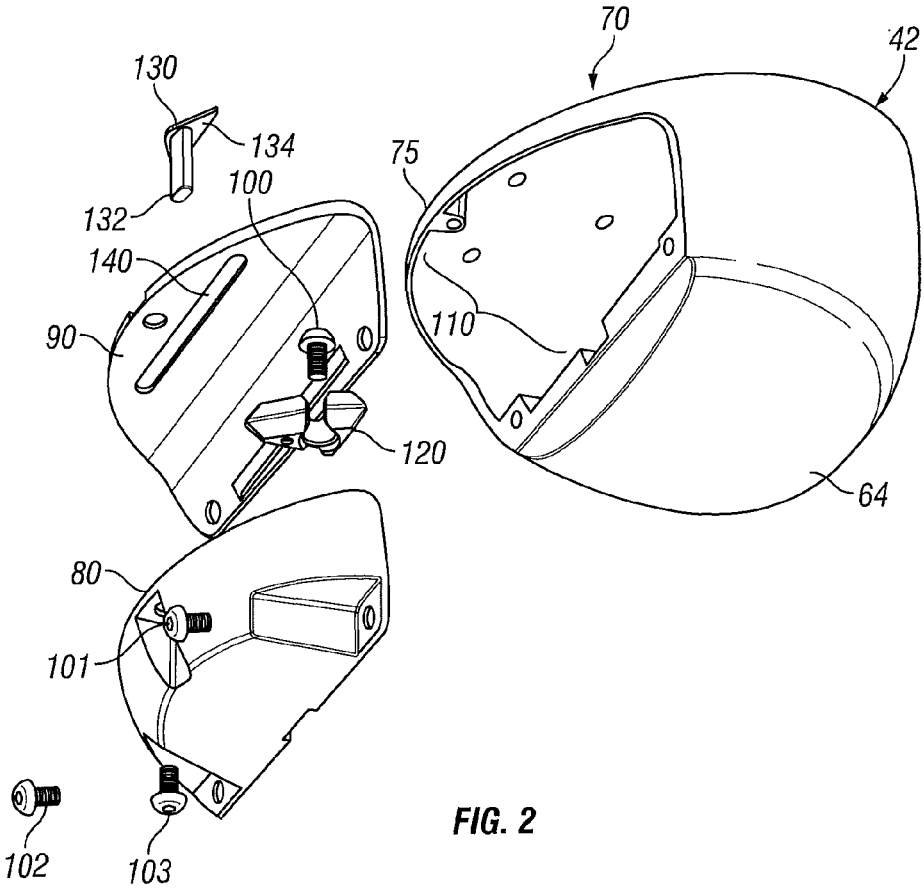
FIG. 2 is an exploded, rear, toe-side view of the golf club head shown in FIG. 1.
Figure 3:
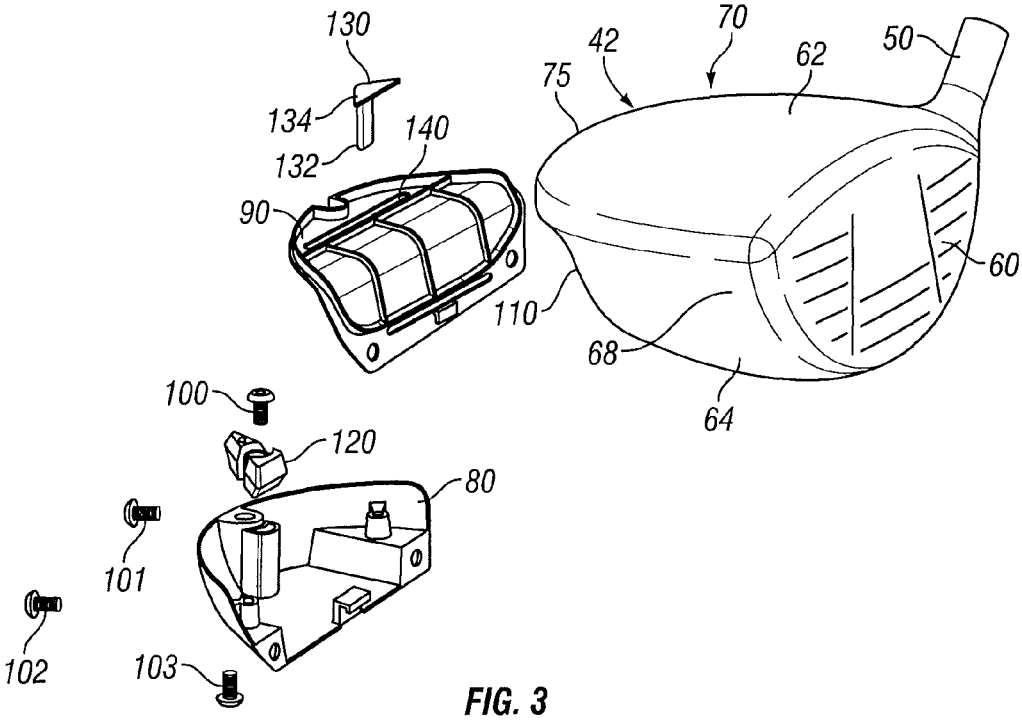
FIG. 3 is an exploded, toe-side view of the golf club head shown in FIG. 1.

Exploded views of the preferred embodiment of the present invention are shown in FIGS. 1-3. The golf club head 40 shown in FIGS. 1-3 has a hollow interior and is generally composed of a body 42 having a face 60, an aft body 70 comprising a crown 62 and a sole 64, and a hosel 50, a back cap 80, a gasket 90, screws 100, 101, 102, 103, a movable weight 120, and a slider tee 130. The club head body 42 also may optionally have a ribbon, skirt, or side portion (not shown) disposed between the crown 62 and sole 64 portions. The golf club head body 42 is preferably partitioned into a heel section 66 nearest the hosel 50, a toe section 68 opposite the heel section 66, and a rear section 75 opposite the face component 60. The embodiment of the golf club head 40 shown in FIGS. 1-16 has a volume of at 300 to 500 cubic centimeters, more preferably a volume of 440 to 480 cubic centimeters, and most preferably a volume of 450 to 470 cubic centimeters, a mass of 160 to 225 grams, and most preferably a mass of 180 to 215 grams, and a face 60 with a characteristic time that is close to, but does not exceed, 257 μs.

In the preferred embodiment shown in FIGS. 1-3, the face 60, aft body 70, and hosel 50 are made of titanium. The surfaces of titanium investment castings are generally contaminated with oxygen due to a reaction with the oxide mold material, a ceramic shell system. This contamination creates a brittle surface layer called α-case, which must be removed or the titanium will be subject to cracking and failure during use. The shell system of the present invention retards the formation of α-case on the surface of the titanium. In particular, the golf club head body 42 of the present invention is designed as a one-piece casting that does not require any secondary operation(s) to affix the face 60, sole 64, or crown plate 62 to the body 42. The club head body 42 of the present invention has all these portions integrally cast together in one complete unit.

An opening 110 in the aft portion 70 of the club head, shown in FIGS. 1 and 2, is large enough to extract all the internal core pieces of the molding tool after casting. This opening is then covered by a gasket 90, which fits between the titanium body 42 and a lightweight back cap 80. The integral casting method allows for better sound, strength, and thickness control because it eliminates the seam created by a welding operation, which adds weld material that must then be ground away. Welding operations add cost due to the process, consumable materials, fixturing, and finishing. The preferred driver of the present invention is not subject to such secondary welding and finishing operations.

In other embodiments, the face 60, aft body 70, and hosel 50 may be made from cast, machined, or forged metals or from composite materials, and may be formed integrally or pieced together. In yet other embodiments, the face 60, aft body 70, and hosel 50 may each be composed of different materials. For example, the face 60 may be made of cast titanium alloy and the crown 62 may be made of a composite material. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

In the preferred embodiment shown in FIGS. 1-3, the back cap 80 is composed of a composite material. In another embodiment, the back cap 80 is composed of magnesium or magnesium alloy. In other embodiments, the back cap 80 of the present invention may be made from another, very light-weight material, such as aluminum or plastic, to minimize the mass of the back cap and provide more available mass for the movable weight 120. The back cap 80 of the present invention may, in other embodiments, be made of a material with a density less than that of the remainder of the golf club head 40, including the face 60, aft body 70, hosel 50, and weight 120.

Figure 4:
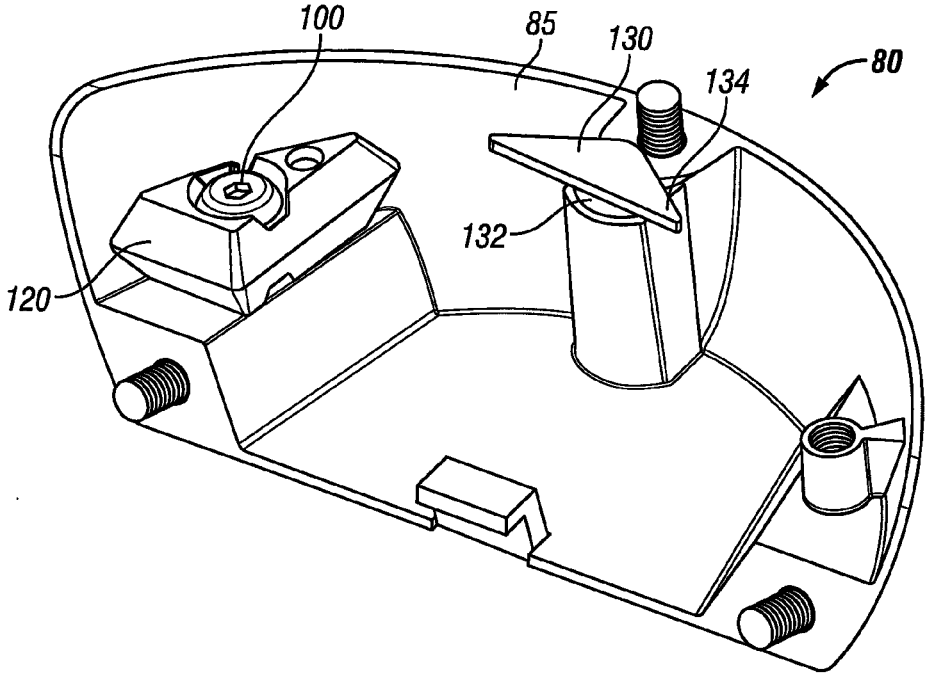
FIG. 4 is an interior, perspective view of the back cap and weight shown in FIG. 1 in an assembled configuration according to one embodiment of the present invention.
Figure 5:
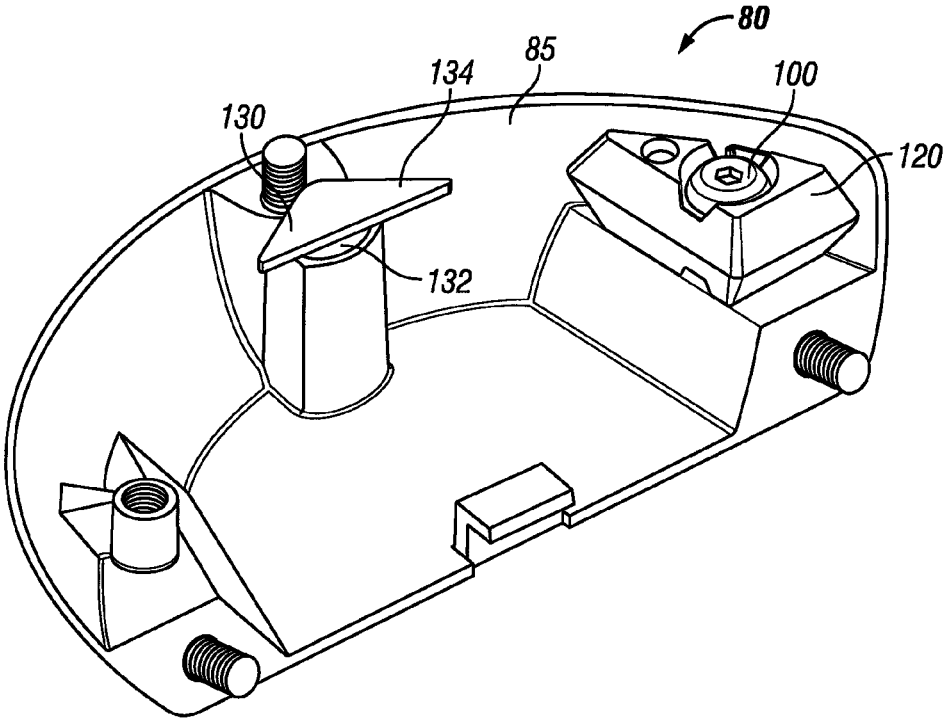
FIG. 5 is an interior, perspective view of a back cap and weight shown in FIG. 1 in an assembled configuration according to another embodiment of the present invention.

As shown in more detail in FIGS. 4 and 5, the back cap 80 holds a weight 120 having a weight of 1 to 50 grams, more preferably 1 to 30 grams, and most preferably a weight of approximately 5 to 20 grams in a desired location. The weight 120 is preferably composed of a material having a higher density than the material used to make the gasket 90 and the back cap 80, including, but not limited to, stainless steel, titanium alloy, and tungsten alloy.

Figure 9:
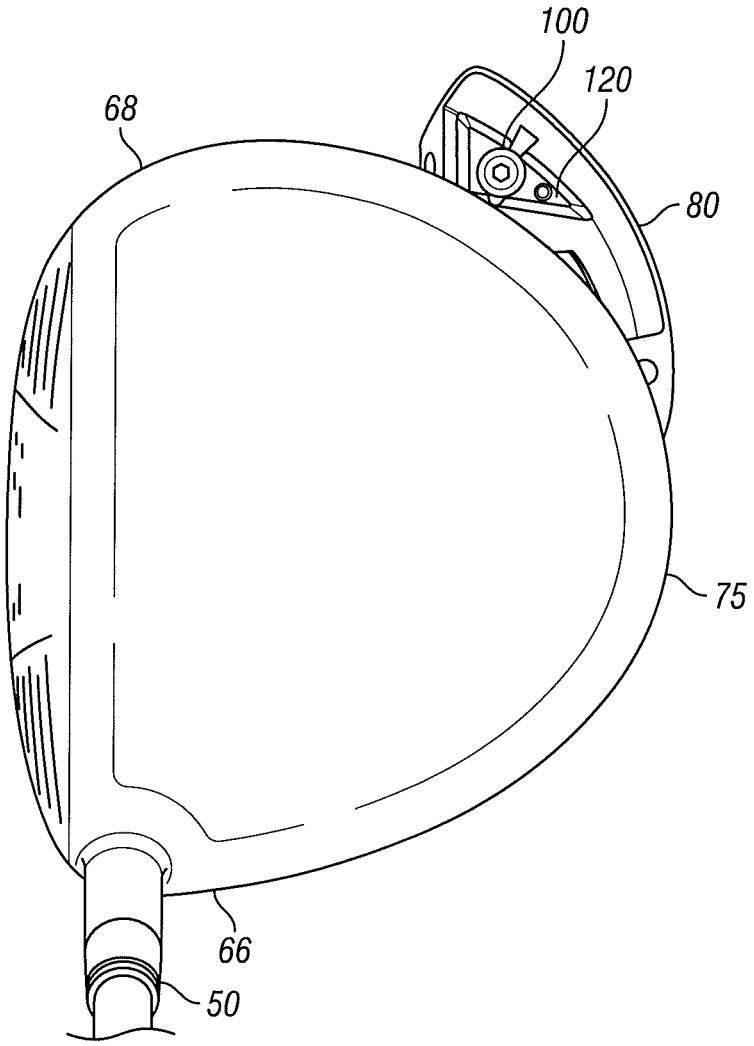
FIG. 9 is a top, plan view of the golf club head shown in FIG. 1 in a fully assembled configuration, with the back cap slid towards the toe to reveal a weight.
Figure 10:
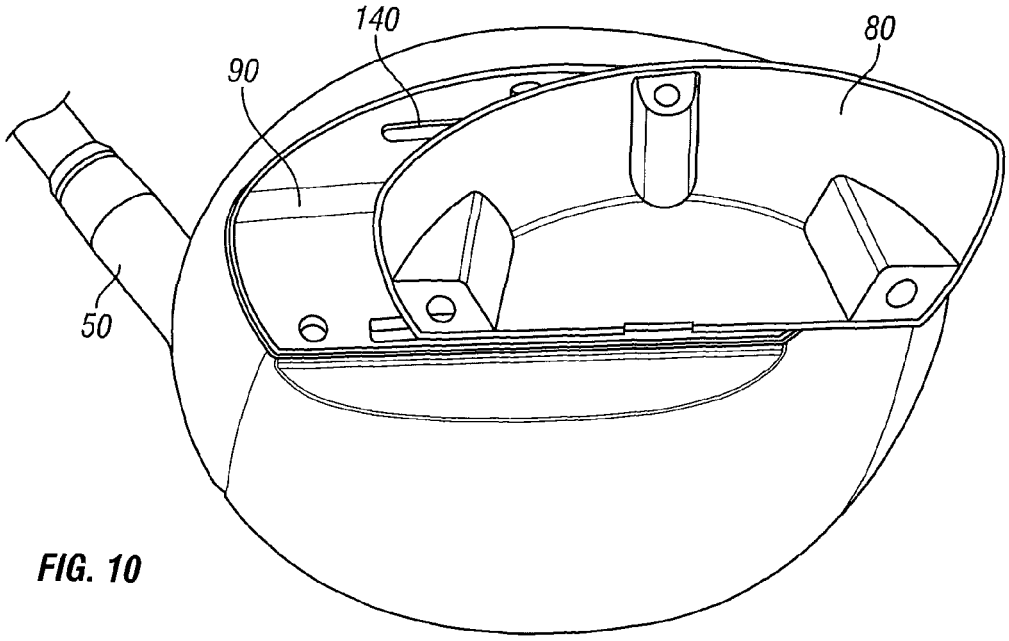
FIG. 10 is a bottom, perspective view of the assembled golf club head shown in FIG. 9.

In the embodiment depicted in FIGS. 4, 9, and 10, the weight 120 is attached to an interior surface 85 of the back cap 80 with a screw 100 on the side of the back cap 80 closest to the toe section 68 to result in a neutrally weighted club head 40. In the embodiment depicted in FIGS. 5, 11, and 12, the weight 120 is attached to an interior surface 85 of the back cap 80 with a screw 100 on the side of the back cap 80 closest to the heel section 66 to result in a draw weighted club head 40. These two positions affect a different sidespin to the ball which for some golfers will improve the ball flight of the golf ball for greater distance and directional control. The weight 120 may be removably attached to the back cap 80 by means other than a screw 100 including, but not limited to, removable adhesive or snap-in features. The presence in the back cap 80 of a receptacle, or visually observable features, for receiving the weight 120 or a screw 100 for affixing the weight 120 to the back cap 80 constitutes a predefined weight-receiving location.

Table 1 shows mechanical properties and data related to a neutrally-weighted driver designed according to the present invention, while Table 2 shows mechanical properties and data related to a draw-weighted driver designed according to the present invention. These tables demonstrate that the location of the weight 120 within the back cap 80 can affect the center of gravity and inertia value of a golf club head 40, among other things.

TABLE 1

| | |
|---|---|
| Impact Loft: | 11.000 |
| Design Loft: | 11.000 |
| Lie: | 0.000 |
| Bulge: | 12.000 |
| Roll: | 10.004 |
| Face Angle: | 0.000 |
| F1: | 3.225 |
| Total Mass: | 198.038 |
| Head Frame Mass Properties: | |

TABLE 1-continued

| |
|---|
| CGX, CGY, CGZ: 0.7483, 0.7982, 1.1275 |
| IXX, IYY, IZZ: 2829.59, 2635.67, 4092.70 |
| IXY, IXZ, IYZ: 393.50, −73.80, −109.64 |
| Hosel Frame Mass Properties: |
| CGX, CGY, CGZ: 0.7483, 1.2922, −2.7366 |
| IXX, IYY, IZZ: 2829.59, 3192.93, 3535.44 |
| IXY, IXZ, IYZ: 284.95, −281.23, −716.54 |
| Impact Frame Mass Properties: |
| CGX, CGY, CGZ: 1.3480, −0.0090, 0.1431 |
| IXX, IYY, IZZ: 2847.93, 2635.67, 4074.36 |
| IXY, IXZ, IYZ: 407.19, 168.15, −32.54 |
| Impact Center X, Y, Z: −0.6023, 0.8072, 1.2443 |
| Bulge Roll Apex X, Y, Z: −0.6023, 0.8072, 1.2443 |

Component Weight Breakdown:

| Solid Name | Weight (g) | Density (g/in$^3$) | Layer |
|---|---|---|---|
| 1- | 164.80 | 72.400 | 100 |
| 2- | 13.13 | 29.500 | 91 |
| 3- | 8.99 | 127.000 | 91 |
| 4- | 6.35 | 23.100 | 92 |
| 5- | 1.07 | 127.000 | 91 |
| 6- | 1.07 | 127.000 | 91 |
| 7- | 1.07 | 127.000 | 91 |
| 8- | 1.07 | 127.000 | 91 |
| 9- | 0.59 | 23.100 | 88 |

TABLE 2

| | |
|---|---|
| Impact Loft: | 11.000 |
| Design Loft: | 11.000 |
| Lie: | 0.000 |
| Bulge: | 12.000 |
| Roll: | 10.004 |
| Face Angle: | 0.000 |
| F1: | 3.225 |
| Total Mass: | 198.039 |
| Head Frame Mass Properties: | |
| CGX, CGY, CGZ: 0.7483, 0.6696, 1.1274 | |
| IXX, IYY, IZZ: 2772.49, 2635.88, 4035.61 | |
| IXY, IXZ, IYZ: 127.37, −74.03, −61.12 | |
| Hosel Frame Mass Properties: | |
| CGX, CGY, CGZ: 0.7483, 1.1856, −2.6648 | |
| IXX, IYY, IZZ: 2772.49, 3130.24, 3541.25 | |
| IXY, IXZ, IYZ: 64.19, −132.60, −671.80 | |
| Impact Frame Mass Properties: | |
| CGX, CGY, CGZ: 1.3480, −0.1375, 0.1430 | |
| IXX, IYY, IZZ: 2790.74, 2635.88, 4017.35 | |
| IXY, IXZ, IYZ: 136.69, 167.94, −35.69 | |
| Impact Center X, Y, Z: −0.6023, 0.8072, 1.2443 | |
| Bulge Roll Apex X, Y, Z: −0.6023, 0.8072, 1.2443 | |

Component Weight Breakdown:

| Solid Name | Weight (g) | Density (g/in$^3$) | Layer |
|---|---|---|---|
| 1- | 164.80 | 72.400 | 100 |
| 2- | 13.13 | 29.500 | 91 |
| 3- | 8.99 | 127.000 | 91 |
| 4- | 6.35 | 23.100 | 92 |
| 5- | 1.07 | 127.000 | 91 |
| 6- | 1.07 | 127.000 | 91 |
| 7- | 1.07 | 127.000 | 91 |
| 8- | 1.07 | 127.000 | 91 |
| 9- | 0.59 | 23.100 | 88 |

Though the preferred embodiment of the back cap 80 shown in FIGS. 4 and 5 provides only two locations for the weight 120, the back cap 80 in other embodiments may have more than two different locations to which the weight 120 may be affixed or otherwise placed such that a golfer can move the center of gravity (CG) of the golf club head 40 upwards and downwards in addition to toe-wards and heel-wards. The golf club 40 of the present invention may also include more than one weight 120.

Figure 6:
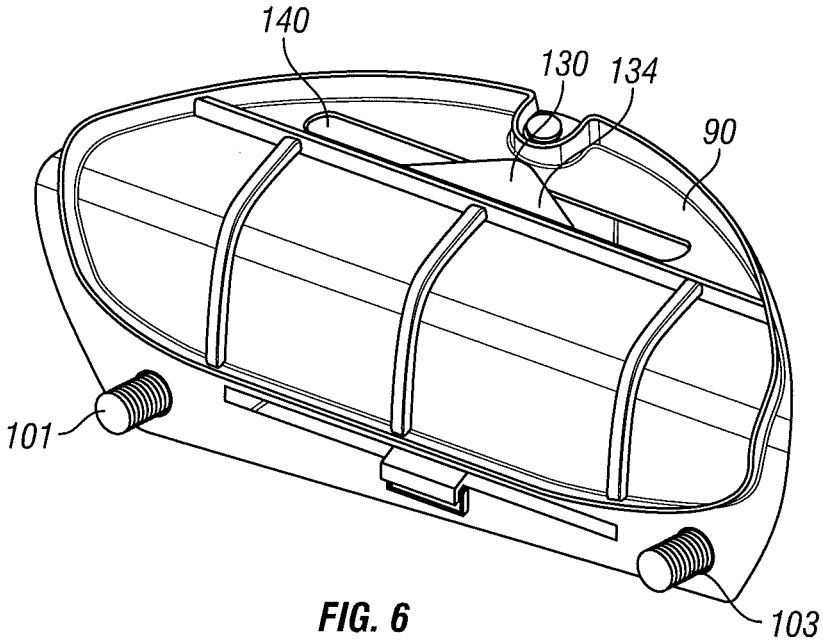
FIG. 6 is a front, perspective view of the gasket and the back cap shown in FIG. 1 in an assembled configuration.
Figure 7:
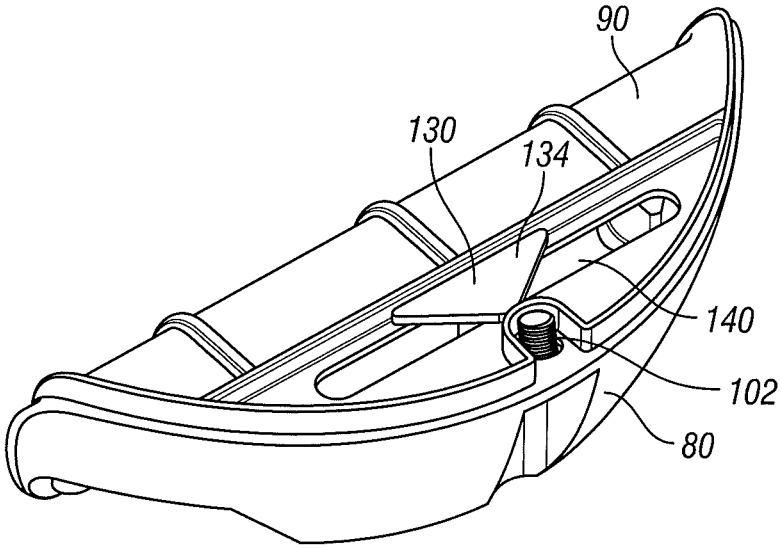
FIG. 7 is a top, perspective view of the gasket and the back cap shown in FIG. 6.
Figure 8:
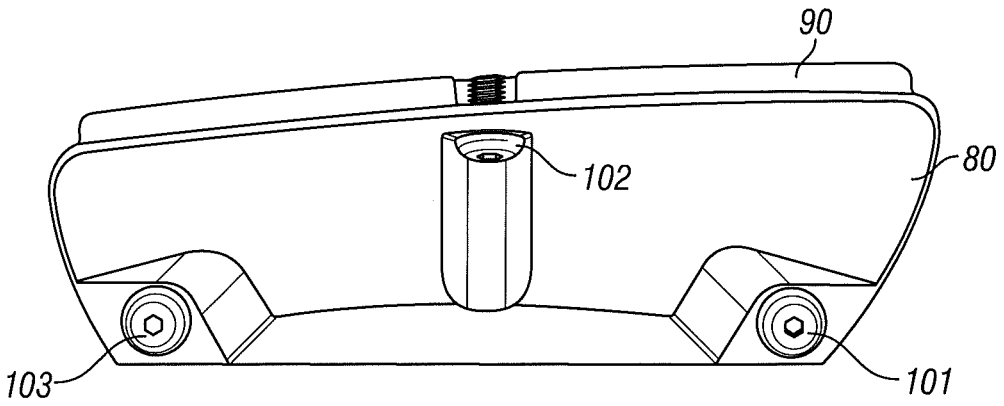
FIG. 8 is a rear, perspective view of the gasket and the back cap shown in FIG. 6.

As shown in more detail in FIGS. 6-8, the gasket 90 is fixed to the back cap 80 with screws 101, 102, 103. The gasket 90 of the preferred embodiment is made of aluminum. In other embodiments, the gasket 90 may be composed of another lightweight material, including, but not limited to, magnesium, magnesium alloy, plastic, or composite graphite. As shown in FIGS. 1-3, the gasket 90 covers the opening 110 in the aft portion 70 of the club head. The gasket 90 is glued and/or mechanically fastened over the opening 110, which allows the back cap 80 to be more precisely fastened to the club head 40. In the preferred embodiment depicted in FIGS. 1-16, the golf club head body 42 is hollow, and the gasket 90 prevents foreign objects from entering the hollow interior of the body 42.

The gasket 90 also separates the golf club head 40 body from the material of the back cap 80. This separation prevents an electrochemical process called galvanic corrosion, which occurs when reactive materials in the presence of an electrolyte (e.g., water) come into contact with one another. In the preferred embodiment, where the body 42 is made of titanium, the gasket 90 is made of aluminum, and the back cap 80 is made of a lightweight material, the separation between the body 42 and back cap 80 is desirable, particularly if the back cap 80 is made of a metal material. The body 42, gasket 90, and lightweight back cap 80 of the preferred embodiment of the present invention are also coated with a material to insulate them from inadvertent contact with reactive materials. In other embodiments, the body 42, gasket 90, and/or lightweight back cap 80 may or may not be coated.

In the preferred embodiment, a slider tee 130 mechanism allows the back cap 80 to move along the gasket 90 to give a golfer access to the repositionable weight 120, which can be relocated into receptive areas within the interior of the back cap 80. The slider tee 130 may be made from one or more lightweight materials, including, but not limited to, aluminum, aluminum alloy, magnesium, composite, and plastic. As shown in FIGS. 1-5, the end portion 132 of the slider tee 130, which in the preferred embodiment is made of aluminum, is threaded through a slot 140 in the gasket 90 and inserted into a socket 135 in the back cap 80. The end portion 132 of the slider tee 130 may be permanently or removably secured within the socket 135 by any means, but preferably by an adhesive. The head portion 134 of the slider tee 130, shown in FIGS. 1-7, prevents the slider tee 130 from slipping through the slot 140. The slot 140 permits the slider tee 130, and thus the back cap 80, to slide laterally along the gasket 90. In other embodiments, the slot 140 may permit the back cap 80 to slide up and down in addition to, or instead of, side to side.

Figure 11:
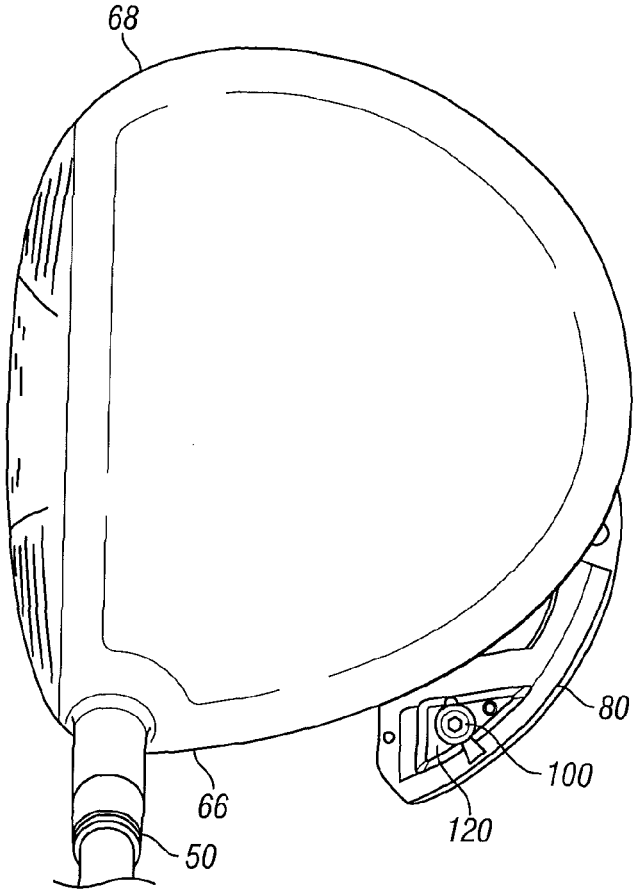
FIG. 11 is a top, plan view of the assembled golf club head according to another embodiment of the present invention, with the back cap slid towards the heel to reveal a weight.
Figure 13:
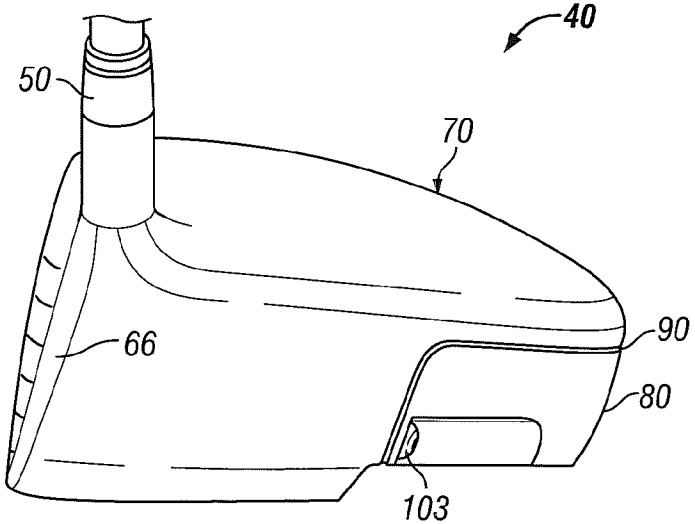
FIG. 13 is a heel, plan view of the golf club head shown in FIG. 12.
Figure 12:
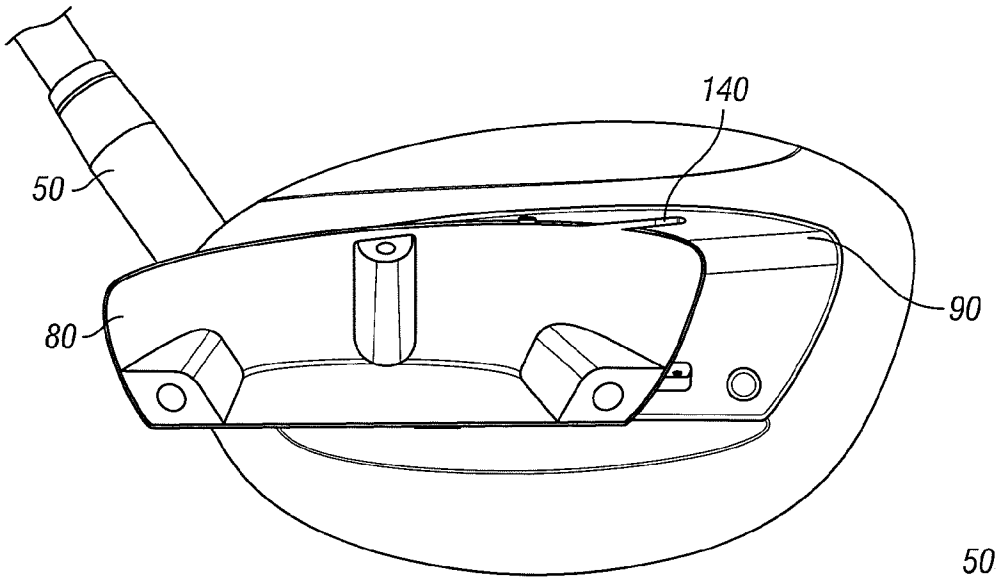
FIG. 12 is a rear, perspective view of the assembled golf club head shown in FIG. 1.
Figure 14:
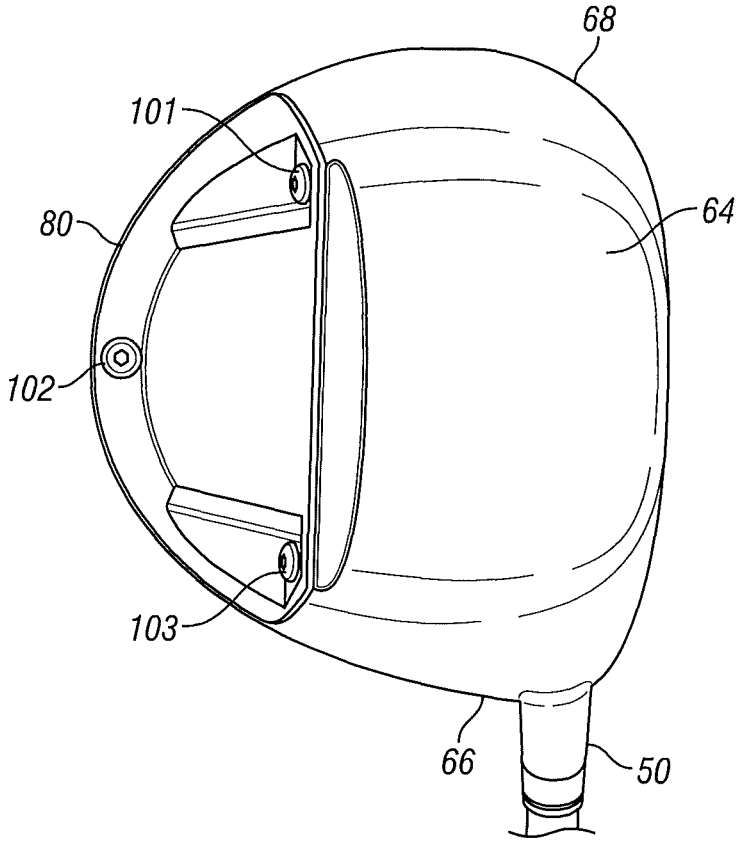
FIG. 14 is a bottom, plan view of the assembled golf club head shown in FIG. 12.
Figure 15:
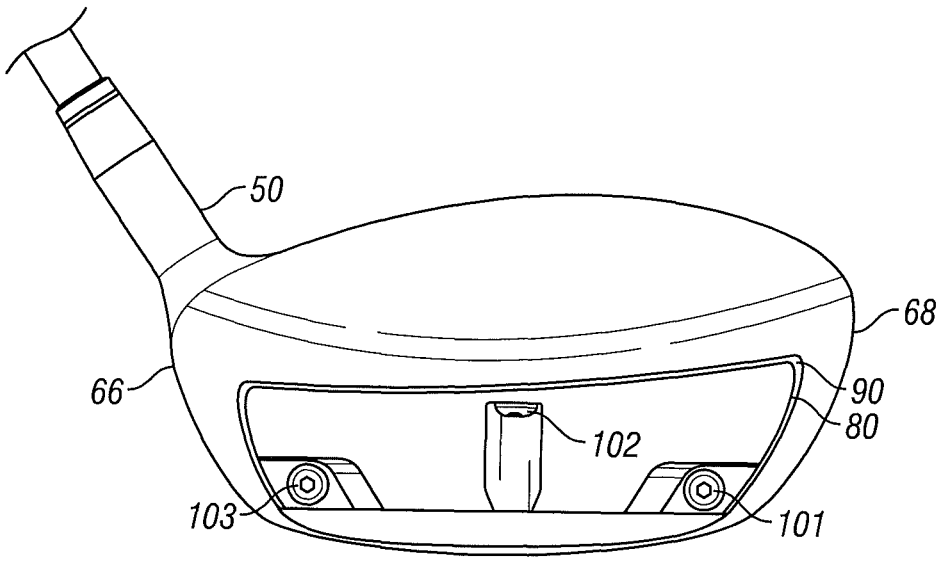
FIG. 15 is a rear, plan view of the golf club head shown in FIG. 12.
Figure 16:
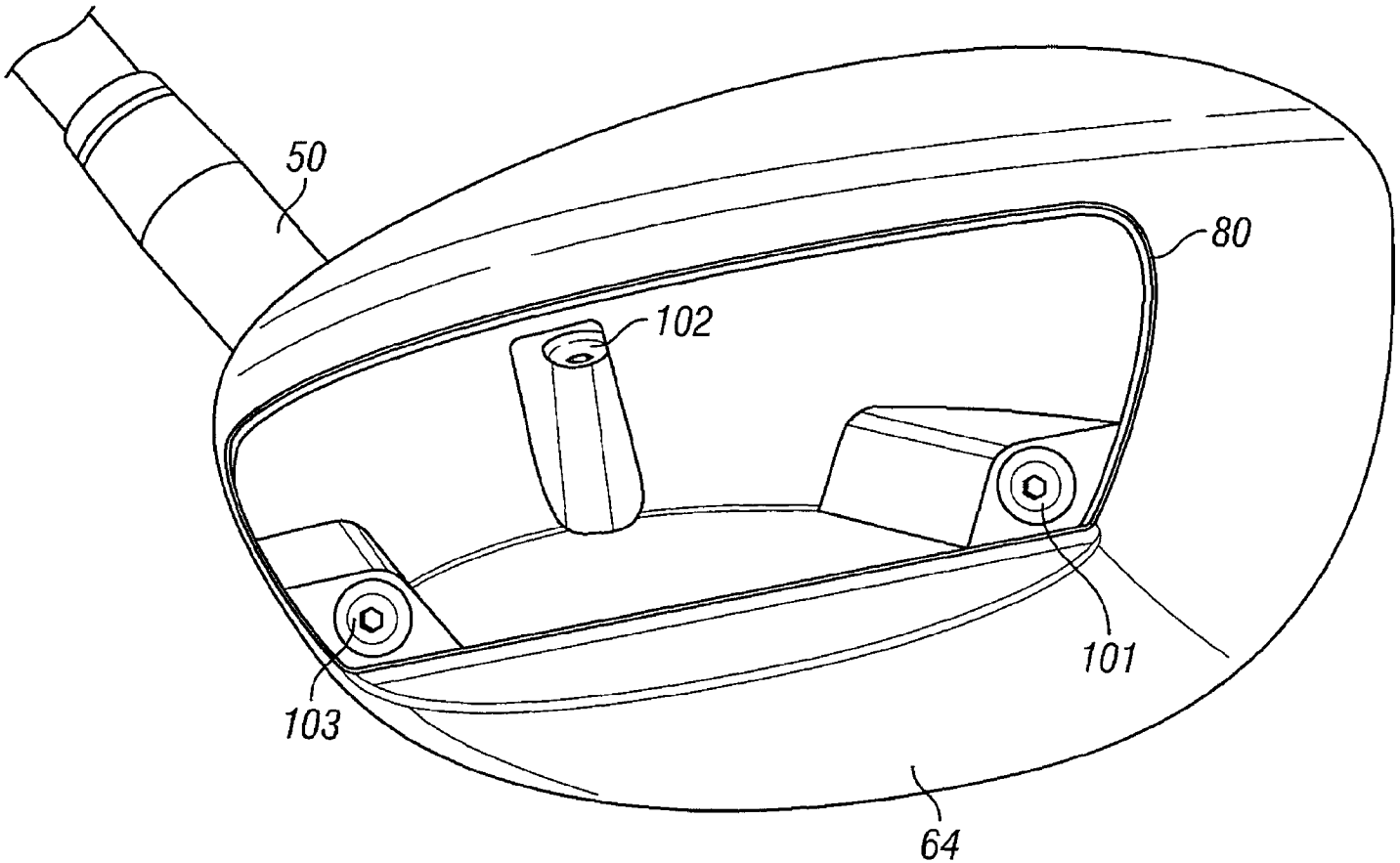
FIG. 16 is a rear, perspective view of the golf club head shown in FIG. 12.

Removal of the screws 101, 102, 103 loosens the back cap 80 from the golf club head 40 and gasket 90. FIGS. 9-10 show a neutrally-weighted embodiment of the present invention without the screws 101, 102, 103. In this embodiment, the back cap 80 has been slid along the slot 140 of the gasket 90 in the direction of the toe section 68 to reveal the weight 120. FIGS. 11-12 show a draw-weighted embodiment of the present invention without the screws 101, 102, 103. In this embodiment, the back cap 80 has been slid along the slot 140 of the gasket 90 in the direction of the heel section 66 to reveal the weight 120. In each of these embodiments, once the weight 120 has been relocated, the back cap 80 can be slid back into a closed position that is fully flush with the gasket 90 and the screws 101, 102, 103 can be replaced.

In the embodiments shown in FIGS. 1-16, the screws 100, 101, 102, 103 used to affix the weight 120 to the back cap 80 and the gasket 90 to the back cap 80 are composed of stainless steel. In other embodiments, the screws 100, 101, 102, 103 may be composed of another material, including a metal, a composite, or a plastic. FIGS. 13-16 show the preferred embodiment of the invention in its fully assembled form.

In an alternative embodiment, the back cap 80 is not movably affixed to the golf club head 40 via a slider tee 130 attached to a gasket 90, but instead is completely removable. In this embodiment, a golfer or fitting professional can detach the back cap 80 from the golf club head 40 by removing all of the screws 101, 102, 103 and alter the location of the weight 120 within the back cap 80. After such modification is completed, the back cap 80 can be re-attached to the golf club head 40.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A wood-type golf club head comprising:

a body comprising a face component and an all body, wherein the body is integrally cast from a metal material, and wherein the aft body has an opening;

a gasket covering the opening;

a back cap having an interior surface, wherein the back cap is slidably affixed to the gasket;

a slider tee comprising an end portion and a head portion; and at least one removable weight positioned on the interior surface of the back cap, wherein the gasket comprises an elongated slot, wherein the back cap comprises a socket, wherein the end portion of the slider tee is threaded through the slot and fixed in the socket, and wherein the head portion of the slider tee is sized to prevent the slider tee from disengaging from the slot.

2. The golf club head of claim 1, wherein the interior surface of the back cap has a plurality of predefined weight receiving locations.

3. The golf club head of claim 1, wherein the interior surface of the back cap has a heel side and a toe side, and wherein each of the heel side and the toe side has at least one predefined weight receiving location.

4. The golf club head of claim 1, further comprising a screw, wherein the at least one removable weight is semi-permanently fastened to the interior surface of the back cap with the screw.

5. The golf club head of claim 1, further comprising a plurality of screws, wherein the gasket is permanently affixed to the aft body with an adhesive, and wherein the back cap is semi-permanently affixed to the gasket with the plurality of screws.

6. The golf club head of claim 1, wherein the gasket and the back cap are each composed of a lightweight material, and wherein the at least one removable weight is composed of a heavy material having a density greater than the density of the lightweight material.

7. The golf club head of claim 6, wherein the lightweight material is selected from the group consisting of composite and aluminum, and wherein the heavy material is selected from the group consisting of stainless steel, titanium alloy, and tungsten alloy.

8. The golf club head of claim 1, wherein the body is integrally cast from titanium alloy.

9. The golf club head of claim 1, wherein the aft body comprises a crown portion and a sole portion, and wherein the opening is located in the sole portion.

10. The golf club head of claim 1, wherein the slider tee is composed of a lightweight material selected from the group consisting of composite, aluminum ahoy, magnesium, and plastic.

11. The golf club head of claim 1, wherein the slider tee permits the back cap to slide along a length of the elongated slot.

12. The golf club head of claim 11, wherein the slider tee permits the back cap to slide on a linear, rotational, or curved path along the length of the elongated slot.

13. The golf club head of claim 1, wherein the body has a volume of approximately 440 to 480 cubic centimeters and a weight of 180 to 210 grams.

14. A driver-type golf club head comprising:

a body having a rearwardly-located opening, wherein the body is composed of a titanium material, and wherein the body has a volume of approximately 440 to 480 cubic centimeters and a weight of 180 to 210 grams;

a movable assembly covering the opening, the movable assembly comprising a gasket composed of an aluminum material and a back cap composed of a composite material;

a slider tee, and at least one weight member removably secured within the movable assembly, wherein the at least one weight member is composed of a high density metal material, wherein the golf club head has no welding in its construction wherein the gasket is affixed to the body with adhesive, and wherein the slider tee movably connects the back cap to the gasket.

15. The driver-type golf club head of claim 14, wherein the at least one weight member is composed of a metal material selected from the group consisting of stainless steel, titanium alloy, and tungsten alloy.

16. The driver-type golf club head of claim 14, wherein the body is integrally cast.

17. A driver-type golf club head comprising:

a body comprising a crown portion composed of a composite material, a face portion composed of a titanium alloy, and a sole portion composed of a titanium alloy, wherein the sole portion comprises a rearwardly located opening, and wherein the face portion and the sole portion are integrally cast;

a gasket covering the opening, wherein the gasket is permanently affixed to the body with an adhesive material, and wherein the gasket is composed of an aluminum alloy;

a slider tee;

a back cap having an interior surface, wherein the back cap is slidably affixed to the gasket with the slider tee;

at least one screw; and at least one removable weight secured to the interior surface of the back cap with the screw, wherein the golf club head has no welding in its construction, and wherein the body has a volume of approximately 440 to 480 cubic centimeters and a weight of 180 to 210 grams.

* * * * *